United States Patent [19]

Garrod

[11] 4,232,593

[45] Nov. 11, 1980

[54] IMPROVEMENTS IN AND RELATING TO THE MANUFACTURE OF RECORD SLEEVES

[76] Inventor: Norman J. Garrod, Great Common, Bletchingley, Surrey, England

[21] Appl. No.: 968,213

[22] Filed: Dec. 11, 1978

[51] Int. Cl.[3] ..... B31B 1/08

[52] U.S. Cl. ..... 493/224; 271/9; 493/228

[58] Field of Search ..... 93/13, 61 R, 62, 61 AC, 93/8 R, 35 R; 198/367; 271/9, 64

[56] References Cited

U.S. PATENT DOCUMENTS

| | | | |
|---|---|---|---|
| 399,987 | 3/1889 | Goss et al. | 271/64 UX |
| 1,782,323 | 11/1930 | Spiess | 271/64 UX |
| 2,233,793 | 3/1941 | Meyer | 271/64 X |
| 2,903,946 | 9/1959 | Honsel | 93/13 |
| 3,008,707 | 11/1961 | McGarvey | 271/64 X |
| 3,802,326 | 4/1974 | Shore | 93/61 R |

*Primary Examiner*—James F. Coan

*Attorney, Agent, or Firm*—Scrivener, Parker, Scrivener, and Clarke

[57] ABSTRACT

A machine for making single and double record sleeves made respectively from one and two sheet material blanks, comprises two input lines each for cutting and creasing a blank and connectable to two first output lines each for making up single record sleeves from blanks cut and creased by the two input lines, and a second output line connectable to both input lines for making up a double record sleeve from blanks cut and creased by the two input lines, connection of the two input lines to one of the first output lines and the second output line being controlled by conditioning means having two corresponding conditions.

5 Claims, 6 Drawing Figures

IMPROVEMENTS IN AND RELATING TO THE MANUFACTURE OF RECORD SLEEVES

The present invention relates to improvements in the manufacture of record sleeves.

There are two types of record sleeves which are made from similar board blanks. One of these sleeves, which we will hereafter call a "single record sleeve", comprises a single pocket for a single record and is made from a single blank comprising two side-by-side square panels with appropriate flaps for connecting the panels together when superimposed. The other of the sleeves, which we will hereafter call a "double record sleeve", has two pockets one or both of which may receive a record. In practice the open mouth of one or both of the two pockets may be closed so that that pocket is incapable of receiving a record. Where both pockets are closed, an additional pocket is provided for a record e.g. as described in patent application No. 20311/77. This sleeve is made from two blanks each comprising two side-by-side square panels and appropriate flaps for connecting the panels when superimposed, one panel of each blank forming one panel of each pocket.

In manufacturing a record sleeve, the or each blank is first printed and finished as required and is then taken to the sleeve make-up machine. In this machine blanks are taken in sequence from a magazine and are fed to a register chain whereby the blank is placed in register for subsequent operations. The blank next passes to a cutter whereby the exact outline of the blank is defined, for example any flaps are defined, then to a creaser whereby creases are made in the blank about which the blank is subsequently folded, to a flap folding device which folds the flaps over to superimpose them on the blank, and to a flap gluing device. The subsequent operations depend on the precise construction of the sleeve.

Because the blanks of the above described sleeves are very similar and certain primary operations are performed regardless of the actual sleeve construction, the machinery used for making the two types of sleeve is very similar.

A machine is known which can be operated to manufacture either single record sleeves or double record sleeves. The machine comprises two input lines and a first output line which is replaceable by a second output line. Each input line includes registering means, a cutter and a creaser together with flap folding and gluing means. To produce a single record sleeve, one of the input lines is not used and the other input line is connected to the first output line in which the blank is folded in half to superimpose the two halves, pressure is applied to the glued areas and finally the open mouth of the sleeve is trimmed. To produce a double record sleeve both input lines are used and the first output line is replaced by the second output line in which the two blanks are superimposed, the central fold line defining the pocket is made and the open end of the or each effective pocket is trimmed. Thus in this machine the output is constant whether double record sleeves or single record sleeves are produced and when producing single record sleeves, one input line is idle. Additionally because of the arrangement, changeover from manufacture of one type of sleeve to manufacture of the other type of sleeve is complicated and takes some hours, during which the whole machine is idle.

According to the present invention there is provided a machine for making single and double record sleeves made respectively from one and two blanks, the machine comprises two input lines each comprising blank registering means, blank cutting means and blank creasing means, two first output lines each comprising means for producing a single record sleeve from a cut and creased blank, a second output line including means for producing a double record sleeve from two cut and creased blanks, and conditioning means having front and second conditions, in the first condition of which each input line is connected to a respective one of the two first output lines and in the second condition of which both input lines are connected to the second output line.

The present invention will be more fully understood from the following description of an embodiment thereof, given by way of example only, with reference to the accompanying drawings, in which.

Figure 1:
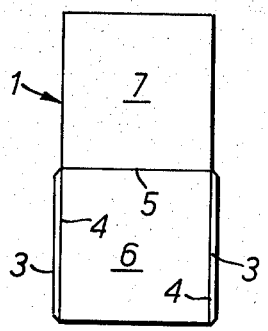
FIG. 1 is a plan view of a blank for a single record sleeve.
Figure 2:
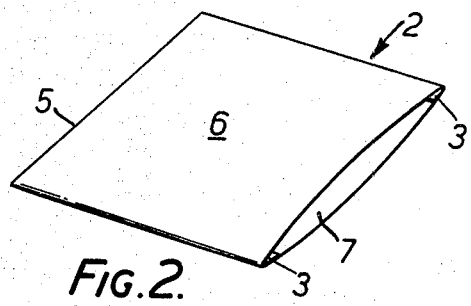
FIG. 2 is a perspective view of a single record sleeve made from the blank of FIG. 1.
Figure 3:
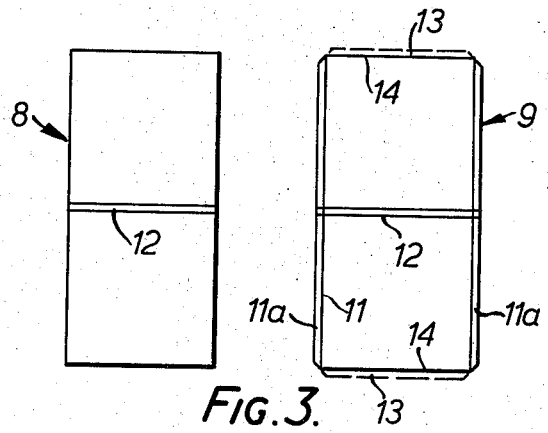
FIG. 3 is a plan view of two blanks for making a double record sleeve.
Figure 4:
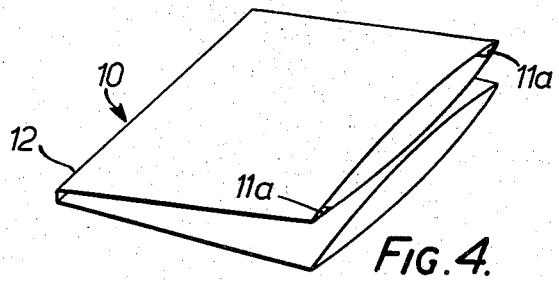
FIG. 4 is a perspective view of a double record sleeve made from the blanks of FIG. 3.
Figure 5A:
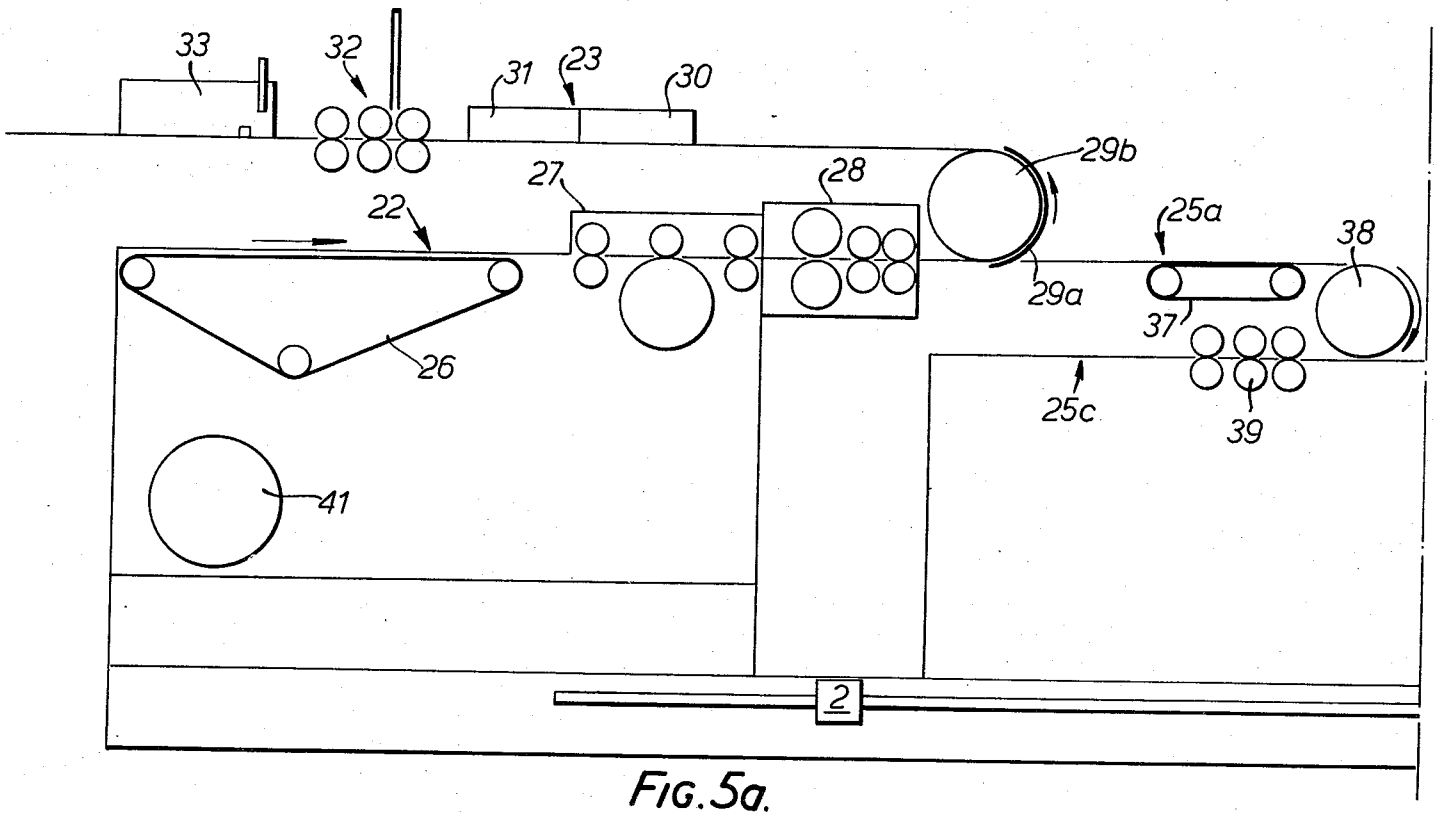
FIG. 5 is a schematic view of an embodiment of a machine according to the present invention for making the sleeves of FIGS. 1 to 4, and comprises FIGS. 5*a* and 5*b* showing respective parts thereof.
Figure 5B:
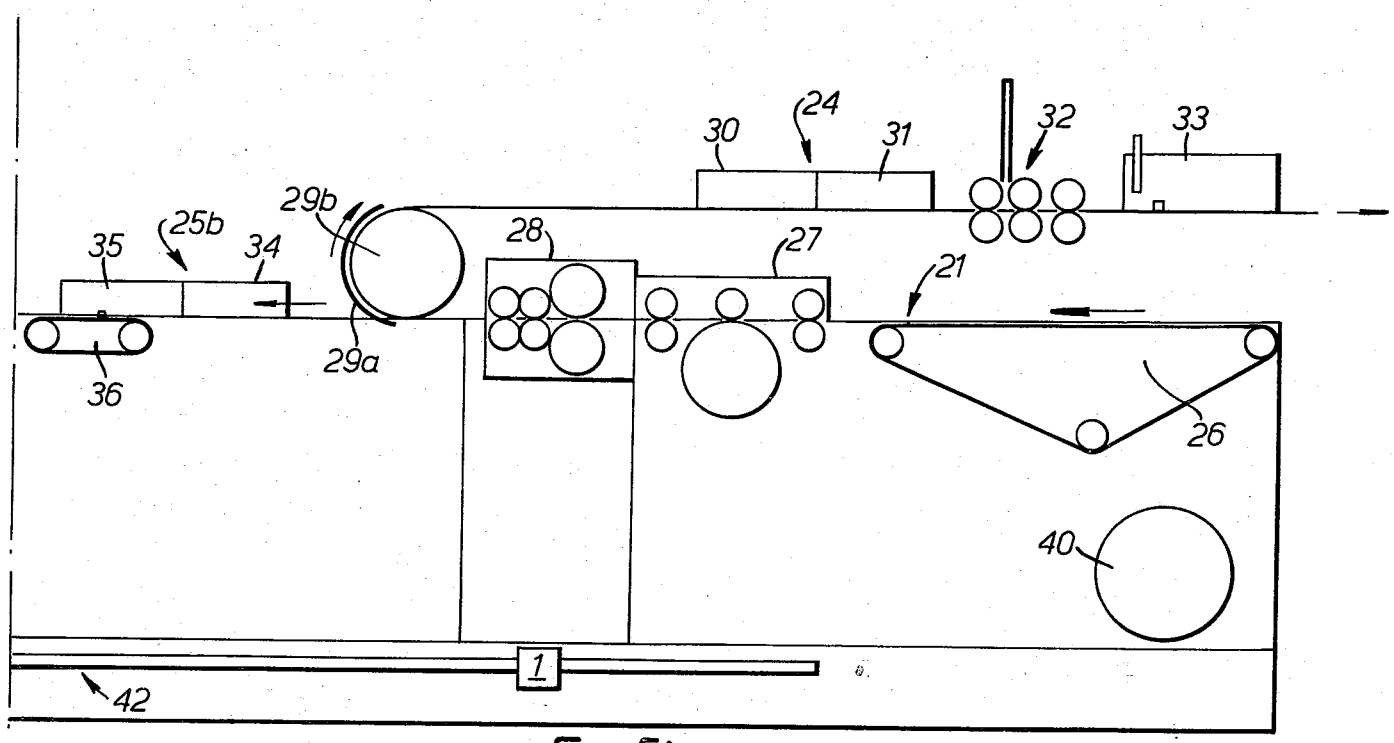

The blanks of the type with which the machine shown in FIG. 5 is concerned are illustrated in FIGS. 1 to 4. FIGS. 1 and 2 show a blank 1 for a single record sleeve and the resulting sleeve and the resulting sleeve 2. The sleeve is made from a rectangular blank by sequentially defining flaps 3, making fold lines 4 and 5 about which the flaps 3 and panels 6, 7 fold, folding the flaps 3 about the fold lines 4 (which may be double fold lines to provide the sleeve with spines along these edges) to overlie the panel 6, applying glue to the flaps 3 or to the corresponding edges of the panel 7, folding the blank along fold line 5 (which may be a double fold line to provide the sleeve with a spine along this edge) to superimpose the panels, pressing the glued areas together and trimming the open mouth of the sleeve.

FIGS. 3 and 4 show the blanks 8, 9 for a double record sleeve and the resulting sleeve 10. The sleeve is made by cutting and creasing the blank 9 to define flaps 11*a* and fold lines 11 (which may be double fold lines to provide the sleeve with spines along these edges). The flaps 11*a* are folded up and glue is applied. Blank 8 is then superimposed on blank 9 and the glued areas are pressed together. The central fold lines 12 between the two pockets of the sleeve may be defined on the individual blanks or may be made at this stage when the blanks are connected together. Finally the open end of the or each pocket is trimmed. Where one or both pockets are closed, this may be effected simply by gluing the panels of that pocket together along the mouth of the pocket. Alternatively a flap 13 (shown in broken lines in FIG. 3) may be provided along that edge of blank 9 which otherwise would define the open mouth of the pocket. The flap 13 is cut out, the fold line 14 defining the flap is made, the flap is folded over and glue is applied, before the flaps 11*a* are cut out. Where the flaps 11*a* include spines, a flap 13 may be provided on each blank 8 and 9 along the mouth of the pocket to be closed, the flaps 13 being folded to overlie the respective panel and subsequently glued together.

It will be appreciated that in the foregoing sleeves, the flaps 3, 11*a* and 13 may be arranged differently on the blank or blanks.

A machine for making the above two types of sleeve is shown in FIG. 5 and comprises two input lines 21, 22, two first output lines 23, 24 each arranged above a respective input line and one second output line 25 comprising a first part 25*a* in continuation of the first input line 21, a second part 25*b* in continuation of the second input line 22, and a third part 25*c* in continuation of the second part 25*b* and below the first part 25*a*. Each input line 21, 22 is supplied with blanks from a feeder (not shown) from which blanks are drawn sequentially. Each blank passes to a register chain 26 whereby the blank is placed in correct register for subsequent processing. Preferably the blanks are fed from the feeder to the register chain 26 in a direction perpendicular to the direction of movement from the chain 26 onwards. From the register chain the blank passes to a cutter 27 for defining the outline of the blank, e.g. any flaps, and then to a creaser 28 for defining fold lines. Passage of the blanks from the ends of the two input lines then depends on whether a one piece sleeve or a two piece sleeve is being produced.

If a one piece sleeve is being produced, the blanks from the two inlet lines 21, 22 are each subject to the actions of an adjustable conditioning means which, as shown, is a diverter 29*a* which diverts the blank round a respective drum 29*b* and into a respective first output line 23 or 24. Each diverter 29*a* may take the form of a plate or a plurality of fingers and is mounted, e.g. pivotally, for movement between the operative position illustrated in which it extends into the path of the blanks and an inoperative position out of the paths of the blanks.

Each first output line 23, 24 comprises devices 30 for folding up the flaps, devices 31 for applying glue to the flaps, a device 32 for folding the blank in half to superimpose the two panels and to apply pressure to the glued areas and a device 33 for trimming the open end of the sleeve.

To manufacture a double record sleeve, the diverters 29*a* are moved to their inoperative positions away from the path of the blanks so that the blanks from the two input lines continue into the first and second parts 25*a*, 25*b* respectively of the second output line 25. As shown the blank from input line 21 passes through devices 34 for folding up the flaps and devices 35 for applying glue to the flaps. The blank then passes to a register 36. Simultaneously a blank from input line 22 passes to a register 37 and then round a drum 38 by which it is held in register to be superimposed on a blank from input line 21 and held in register by the register 36 as the two blanks pass beneath the drum 38 into the third part 25*c* of the output line 25. Pressure is applied downstream to the glued areas by rollers 39. The double record sleeve may then be conveyed to a separate machine in which the central fold lines are made and one or both ends are trimmed or devices for effecting these operations may be provided downstream of the rollers 39.

Advantageously the above described machine includes two motors 40, 41 coupled to a clutch and drive transmission assembly 42 such that the two motors can be operated to drive individually a respective one of the input lines with its associated first output line or one motor 41 can be disengaged and the motor 40 used to drive both input lines and the second output line.

It will be appreciated that if any of the various devices and means on the input and output lines are not required for any particular sleeve construction, they can be rendered ineffective. In a specific embodiment, to facilitate changeover from manufacture of one type of sleeve to manufacture of the other type of sleeve, the creaser 28 in both lines is provided with two lateral creasing rollers one of which is engaged for manufacture of single record sleeves and the other of which is engaged for manufacture of double record sleeves. Each creaser 28 also includes a creasing roller for making the central fold line in single record sleeves and this is disengaged in the manufacture of double record sleeves, where the central fold is made at the end of the manufacturing operation. The creasing roller of the creaser 28 on the input line 22 which is engaged in the manufacture of double record sleeves may be arranged to operate as a cutting roller to laterally trim the blanks passing through this input line, these blanks then being the blanks 8, FIG. 3. The cutters 27 in both input lines, arranged to define the flaps of single record sleeves, are then disengaged when the machine is used to manufacture double record sleeves. It will be appreciated that no changes are required in either output line whichever sleeve type is being manufactured.

For manufacture of double record sleeves of which one or both pockets are closed by one or two flaps 13 (FIG. 3), flap cutting, creasing, folding and gluing devices may be provided between the feeder and the register chain on input line 21, and correspondingly for inlet line 22 where two flaps 13 are provided. This is particularly advantageous where feed from the feeder to the register chain is perpendicular to feed from the register chain onwards because, between the feeder and register chain the lateral edges of the blank are those provided with the flaps 13, so that the flap cutting, creasing, folding and gluing devices can be arranged at each side of the path of the blank and easily brought into operation when required.

There is thus provided a machine which, by relatively simple and quick adjustment, can be used for manufacturing either single record sleeves or double record sleeves and in which both input lines are used whichever type of sleeve is being made. This of course means that the machine will produce twice the number of single record sleeves as double record sleeves working at the same speed and consequently has twice the single record sleeve output of the known machine. Additionally changeover from manufacture of one type of sleeve to manufacture of the other type of sleeve can be effected in minutes rather than hours.

The various means and devices for performing operations on the blanks have not been described in detail as these are conventional to record sleeve manufacturing.

I claim:

1. A machine for making single and double record sleeves made respectively from one and two sheet material blanks, said machine comprising:

two input lines each comprising blank registering means, blank cutting means and blank creasing means;

two first output lines each comprising means for producing a single record sleeve from a cut and creased blank;

a second output line including means for producing a double record sleeve from two cut and creased blanks;

conditioning means having a first and a second condition, in the first condition of which each said input line is connected to a respective one of said two first output lines and in the second condition of which both said input lines are connected to said second output line, wherein each said input line and said respective first output lines are arranged one above the other and said conditioning means comprises, in respect of each said input line, a diverter which in said first condition is arranged to divert a blank from said respective input line to said respective first output line.

2. A machine as claimed in claim 1, wherein said second output line comprises a first part in continuation of one of said input lines, and a second part in continuation of the other of said input lines, each diverter in its second condition being inoperative such that blanks in said input lines will pass to said first and second parts of said second output line.

3. A machine as claimed in claim 2, wherein said second output line comprises a third part in continuation of said second part, said first and second parts being arranged one above the other, and transfer means being provided for transferring a blank from said first part to said third part in register with a blank from said second part.

4. In a machine for making double record sleeves, each made from a first and second sheet material blank comprising a first input line comprising blank registering means, blank cutting means and blank creasing means for cutting and creasing first blanks, a second input line comprising blank registering means for second blanks, and a first output line connected to the first and second input lines for receiving blanks therefrom and comprising means for producing double record sleeves from first and second blanks from the first and second input lines, the improvement comprising means for selectively adapting the machine to make single record sleeves, each from a third sheet material blank, the first input line (21) including means for producing cut and creased third blank for a single record sleeve, the second input line (22) including blank cutting means (27) and blank creasing means (28) for also cutting and creasing third blanks for single record sleeves, the first and second input lines (21, 22) being each selectively connectable to a respective second output line (23, 24), each of which second output lines (23, 24) includes means (30, 31, 32, 33) for producing single record sleeves from cut and creased third blanks, conditioning means (**29*a*, 29*b*) between the first and second input lines (21, 22) and the first and second output lines (23, 24, 25) having a first condition in which the first input lines (21, 22) are connected to the first output line (25) and a second condition in which each first input line (21, 22) is connected to a respective second output line (23, 24**).

5. A machine for making single and double record sleeves made respectively from one and two sheet material blanks, said machine comprising:

two input lines each comprising blank registering means, blank cutting means and blank creasing means;

two first output lines each comprising means for producing a single record sleeve from a cut and creased blank;

a second output line including means for producing a double record sleeve from two cut and creased blanks;

conditioning means having a first and a second condition, in the first condition of which each said input line is connected to a respective one of said two first output lines and in the second condition of which both said input lines are connected to said second output line, first and second drive means for driving independent a respective said input line and its associated first output line when said conditioning means is in its said first condition, and clutch means operable to disengage one of said drive means and engage the other said drive means to drive both said input lines and said second output line when said conditioning means is in its said second condition.

* * * * *